US006370933B1

(12) United States Patent
Majorell et al.

(10) Patent No.: US 6,370,933 B1
(45) Date of Patent: Apr. 16, 2002

(54) DIE AND METHOD FOR REDUCING CONTROLLING THE FORMATION OF FLASH ON PARTS

(75) Inventors: Arne Ronald Majorell, Niskayuna; David Peter Mika, Clifton Park, both of NY (US); Alain Girard, Shefford (CA); Apostolos Pavlos Karafillis, Cambridge, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/511,449

(22) Filed: Feb. 23, 2000

Related U.S. Application Data

(60) Provisional application No. 60/121,739, filed on Feb. 26, 1999.

(51) Int. Cl.[7] ..... B21C 25/02

(52) U.S. Cl. ..... 72/467; 72/357; 72/478

(58) Field of Search ..... 72/467, 272, 360, 72/478, 357; 425/589

(56) References Cited

U.S. PATENT DOCUMENTS

| | | | | | |
|---|---|---|---|---|---|
| 3,089,591 | A | * | 5/1963 | Groos | 72/272 |
| 3,679,345 | A | | 7/1972 | Malutich | 425/406 |
| 4,359,443 | A | * | 11/1982 | Michaels | 425/595 |
| 5,956,993 | A | * | 9/1999 | Akamatsu | 72/478 |

FOREIGN PATENT DOCUMENTS

| | | | | |
|---|---|---|---|---|
| RU | 747558 | * | 7/1980 | 72/272 |

* cited by examiner

*Primary Examiner*—Lowell A. Larson
(74) *Attorney, Agent, or Firm*—Penney Clarke; Donald S. Ingraham

(57) ABSTRACT

A die for reducing the formation of flash on parts includes a first die section and a second die section defining therein a cavity. The first die section includes a pair of first surfaces and the second die section includes a pair of second surfaces which together define a pair of parting lines which extend from opposite sides of the cavity. Desirably, the first die section includes a pair of lands, each extending along the length of one of the parting lines. Each land defines a first surface portion of the first surface and is sized and configured so that the land is elastically loaded, e.g., substantially equal to and less than the elastic limit of the material forming land when forming a part. In another embodiment, a die for reducing the formation of flash includes a land sized and configured so that when a first die section and a second die section are clamped together for forming the part, a second surface portion of the first surface of the first die section engages a second surface of the second die and the stress on the first surface portion is substantially equal to and less than an elastic limit of the land. In a third embodiment, a die includes a first die section and a second die section having a first surface and a second surface, respectively, which together define a parting line having at least one bend for controlling the formation of flash. Methods for forming such dies and methods for forming parts having reduced or controlled formation of flash are also disclosed.

18 Claims, 4 Drawing Sheets

DIE AND METHOD FOR REDUCING CONTROLLING THE FORMATION OF FLASH ON PARTS

RELATED APPLICATION

This application claims the benefit of U.S. Provisional Application No. 60/121,739, filed Feb. 26, 1999, the contents of which are hereby incorporated in its entirety by reference.

BACKGROUND OF THE INVENTION

This invention relates generally to dies and methods for forming parts, and more particularly, to dies and methods for reducing or controlling the formation of flash on parts.

Horizontal split dies typically include a lower die half and an upper die half which together define an inlet, a cavity corresponding to the shape of the desired part, and an outlet. In addition, matingly-engaging portions of the lower die half and the upper die half form a parting-line therebetween.

To form a part, a workpiece is placed in the inlet and pushed through the cavity of the dies by, for example, a forge press. During this extrusion process, large pressures are developed. When the pressure becomes too high, portions of the workpiece are forced between the lower and upper die halves along the parting line.

The resulting thin slab of material formed along the parting line, which remains in contact with the workpiece, is referred to as flash. Flash is undesirable, and therefore, is generally removed via manual grinding operations, which are labor intensive and add to the production cost of the part.

There is a need for dies and methods for reducing, eliminating, or controlling the formation of flash on parts.

SUMMARY OF THE INVENTION

The present invention in one aspect, provides a die for forming a part in which the die includes a first die section and a second die section defining a cavity therein for forming the part. The first die section and the second die section have a first surface and a second surface, respectively, which together define a parting line. The first die section includes a land defining a first surface portion of the first surface. The land is sized and configured so that a stress on the first surface portion is substantially equal to and less than an elastic limit of the land when the first surface portion is engaged with the second surface and the first die section and the second die section are held together with a predetermined force during the forming of the part.

In another aspect of the present invention, the first surface includes a second surface portion offset from the first surface portion so that when the first die section and the second die section are held together with the predetermined force during the forming of the part, the second surface portion engages the second surface and the stress on the first surface portion is substantially equal to and less than an elastic limit of the land.

In another aspect of the present invention, a die for forming a part includes a first die section and a second die section defining a cavity therein for forming the part. The first die section and the second die section each have a first surface and a second surface, respectively, which together define a parting line having at least one bend for controlling the formation of flash when forming the part.

Still other aspects of the present invention include methods for forming such dies and methods for forming a part and reducing or controlling the formation of flash.

DETAILED DESCRIPTION OF THE INVENTION

Figure 1:
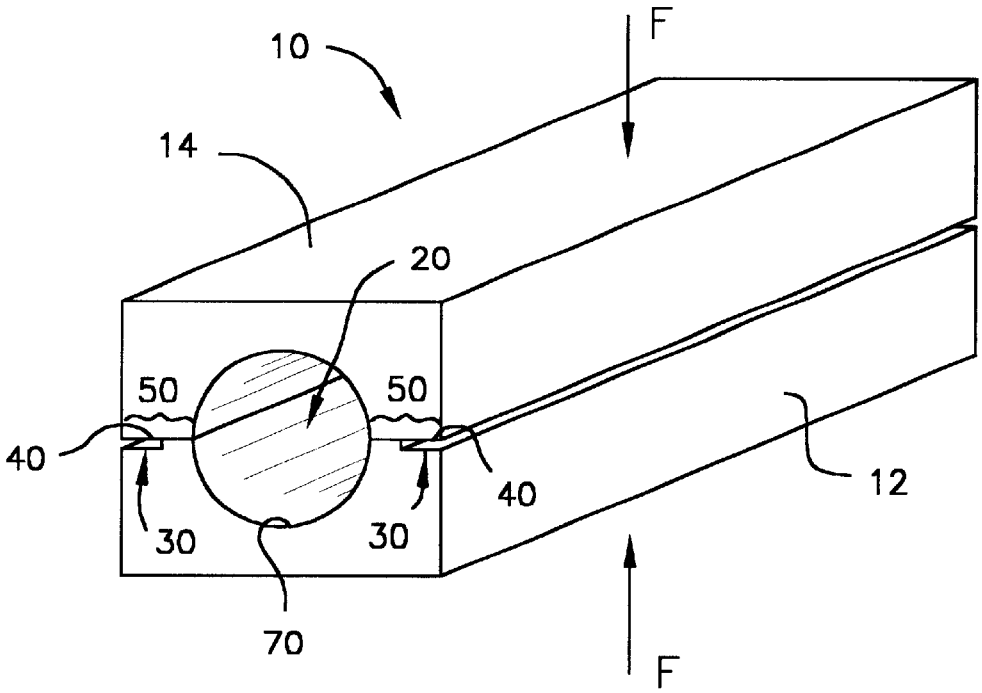
FIG. 1 is a perspective view of a die according to a first embodiment of the present invention for forming a part and reducing the formation of flash.

FIG. 1 illustrates a first embodiment of a die 10 of the present invention for forming a part (not shown). Advantageously, die 10 is configured to reduce, if not eliminate, flash which typically occurs on the part along the parting line of the die.

Die 10 includes a lower die half or first die section 12 and an upper die half or second die section 14 defining therein a cavity 20. First die section 12 includes a pair of first surfaces 30 and second die section 14 includes a pair of second surfaces 40, which surfaces together define a pair of parting lines 50 extending from opposite sides of cavity 20. In this illustrated embodiment, die 10 is an extrusion die having an inlet 70 through which is receivable a material such a cylindrically-shaped slug or a roughly shaped piece of metal, which is subsequently shaped by being forced or extruded through outlet 80 (a portion of which is shown in FIG. 2) and which corresponds to the shape of the part to be formed.

Figure 2:
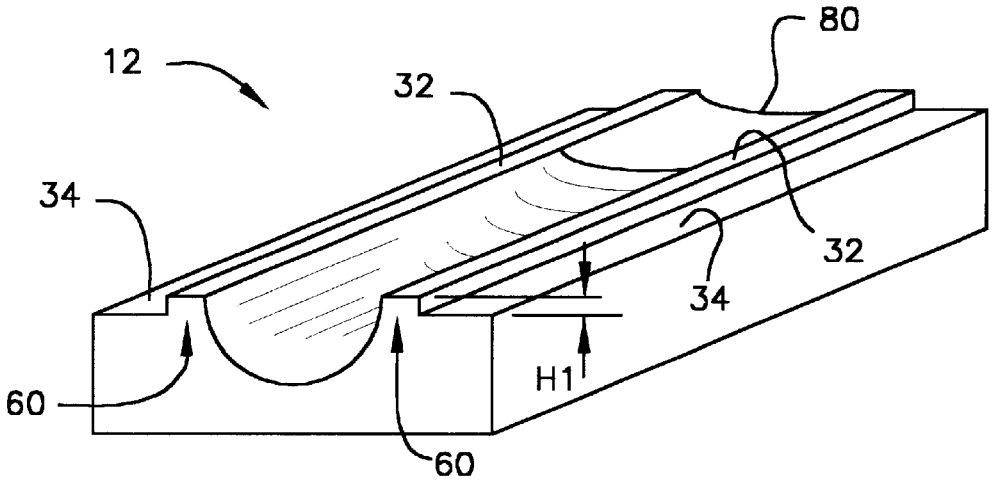
FIG. 2 is an enlarged perspective view of the first die section of the die shown in FIG. 1.

As best shown in FIG. 2, first die section 12 includes a pair of lands 60, each of which extends along the length of one of parting lines 50. In particular, each land 60 defines a first surface portion 32 of first surface 30. When first and second die sections 12 and 14 are held or clamped together during the forming of a part, first surface portion 32 is engageable with second surface 40 while a second surface portion 34 of first surface 30 remains spaced-apart from second surface 40.

Typically, a holding fixture or press is used to hold the die sections together when forming a part. The press often has a limited capacity to apply a force resulting in a compressive pressure along the parting line so that reduced matingly-engaging surfaces or a reduced contact area of the parting line between the die sections result in an increased compressive pressure along the contact area of the parting line. Desirably, the reduced contact area increases the compressive pressure on the contact area to reduce and inhibit the formation of flash. For a given die geometry, the optimal contact area is a function of the press clamping capacity or desired clamping force, the die workpiece contact interaction, and the material properties of the workpiece and the die.

Figure 3:
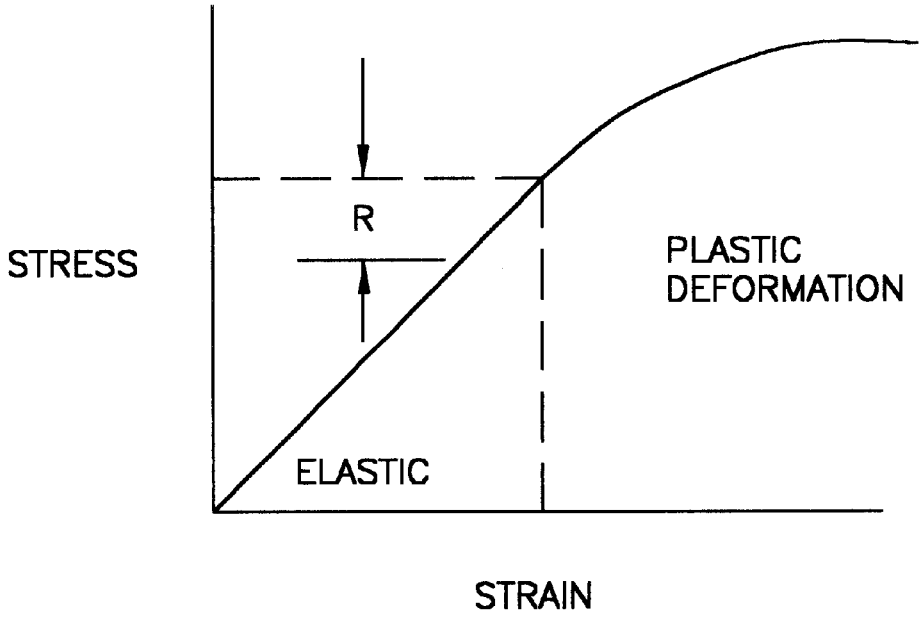
FIG. 3 is a graph of stress versus strain for a material forming the land of the first die section shown in FIG. 2.

For example, for a given predetermined operating holding or clamping force on the die sections, lands 60, and in particular surfaces 32, are sized and configured to maximize the stress on surface 32 while avoiding permanent deformation of land 60 and the corresponding portion of surface 40. Under loading and unloading conditions, the land is desirably elastic, e.g., capable of recovering size and shape after deformation. Advantageously, the land is sized and configured so that it is elastically loaded near, e.g., substantially equal to and less than, the elastic limit or yield strength of the material. For example, for a land formed from a metal, first surface portion 32 is sized and configured so that the stress is generally in a range R as shown in FIG. 3, to inhibit, if not eliminate, portions of the workpiece from being squeezed between the matingly-engaging surfaces or contact areas of the parting lines of the die.

The elastic limit is the highest stress at which all deformation strains are fully recoverable. For most materials this can be considered the practical limit to the maximum stress a component can withstand and still function as designed. Beyond the elastic limit, additional strain results in permanent deformation of the materials. Because the elastic limit is difficult to determine precisely, engineers generally use the yield strength. The yield strength is the stress which will produce a small amount of permanent deformation, equal to a small strain, referred to as offset. The most common offset for structural metals is 0.2%.

Figure 4:
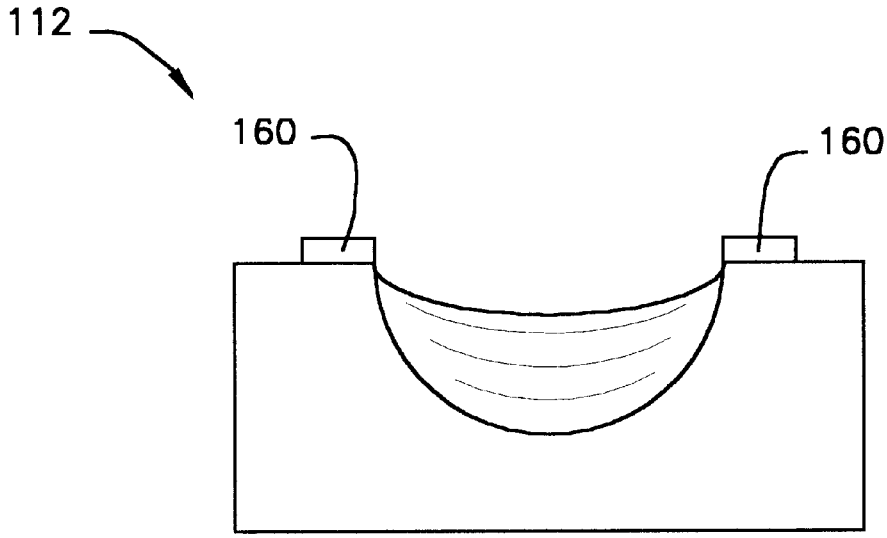
FIG. 4 is an end view of an alternative embodiment of a first die section having separately attachable rails for forming the lands.

Land 60 is desirably integrally formed with first die section 12. Alternatively, as shown in FIG. 4, a first die section 112 may include a pair of separately attachable rails 160. Such rails may be separately formed and attached or formed by various deposition techniques such as, CVD (chemical vapor deposition), PVD (physical vapor deposition), and laser cladding. Advantageously, the rail may comprise a material having increased material properties compared to the main portion of the die sections, e.g., to reduce wear and allow an increased loading force on the dies to keep out flash. The dimensions of the land (e.g., the width and the length) are a function of the desired contact pressure which is kept as high as possible (e.g., close to elastic limit) to inhibit or prevent the formation of flash. For an extrusion of a steel workpiece under hot forming conditions having a 2,580 square millimeter (2 square inch) cross-sectional area and an extrusion ratio of 5, the rail dimensions are typically on the order of 7.6 millimeters (0.3 inch) in width, 50 millimeters (2 inches) to 152 millimeters (6 inches) in length, and 0.25 millimeter (0.01 inch) in height. Furthermore, from the present description, it will be appreciated by those skilled in the art that both the first die section and the second die section may be provided with correspondingly sized integrally formed or separately attachable lands disposed along and defining portions of the parting lines.

Figure 5:
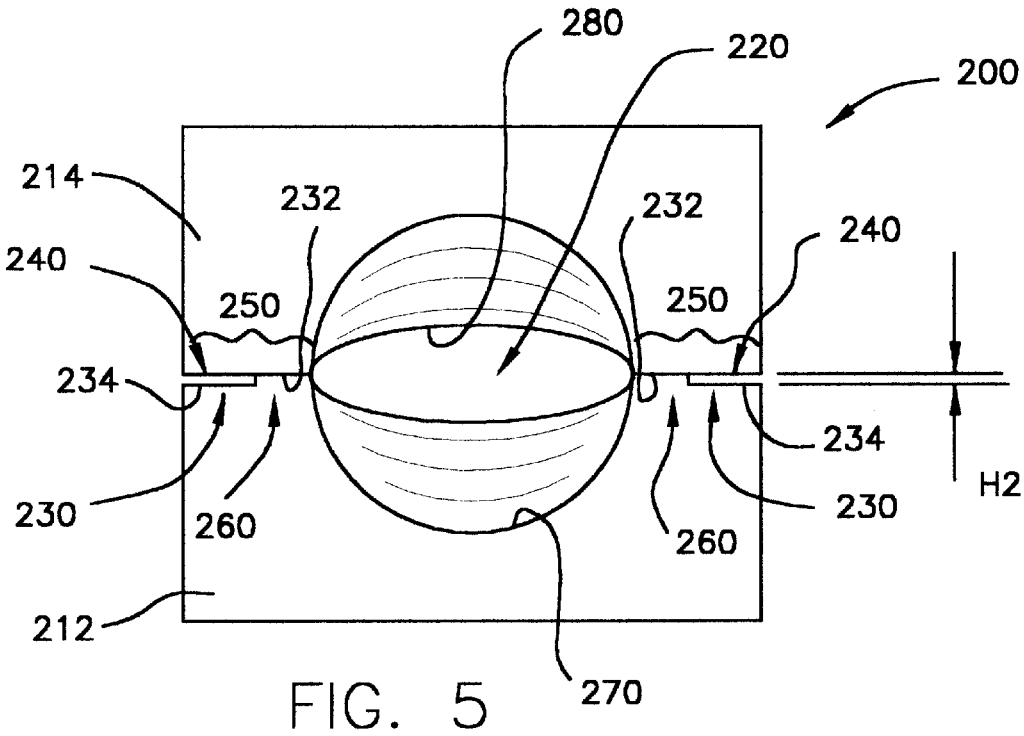
FIG. 5 is an end view of a die according to a second embodiment of the present invention for forming a part and reducing the formation of flash.

FIG. 5 illustrates a second embodiment of a die 200 of the present invention for forming a part (not shown). Die 200 includes a lower die half or first die section 212 and an upper die half or second die section 214 defining therein a cavity 220. First die section 212 includes a pair of first surfaces 230 and second die section 214 includes a pair of second surfaces 240 which surfaces together define a pair of parting lines which extend from opposite sides of cavity 220. In this illustrated embodiment, die 200 is an extrusion die having an inlet 270 through which is receivable a material such a cylindrically-shaped slug or a roughly shaped piece of metal which is subsequently shaped by being forced or extruded through outlet 280 which corresponds to the shape of the part to be formed.

Die 200 reduces the likelihood of an operator applying too great a compressive load on the die in a holding fixture or a press, e.g., by shimming the dies in the holding blocks to change the compressive loads, and overloading the die causing permanent deformation of the land and die.

Figure 6:
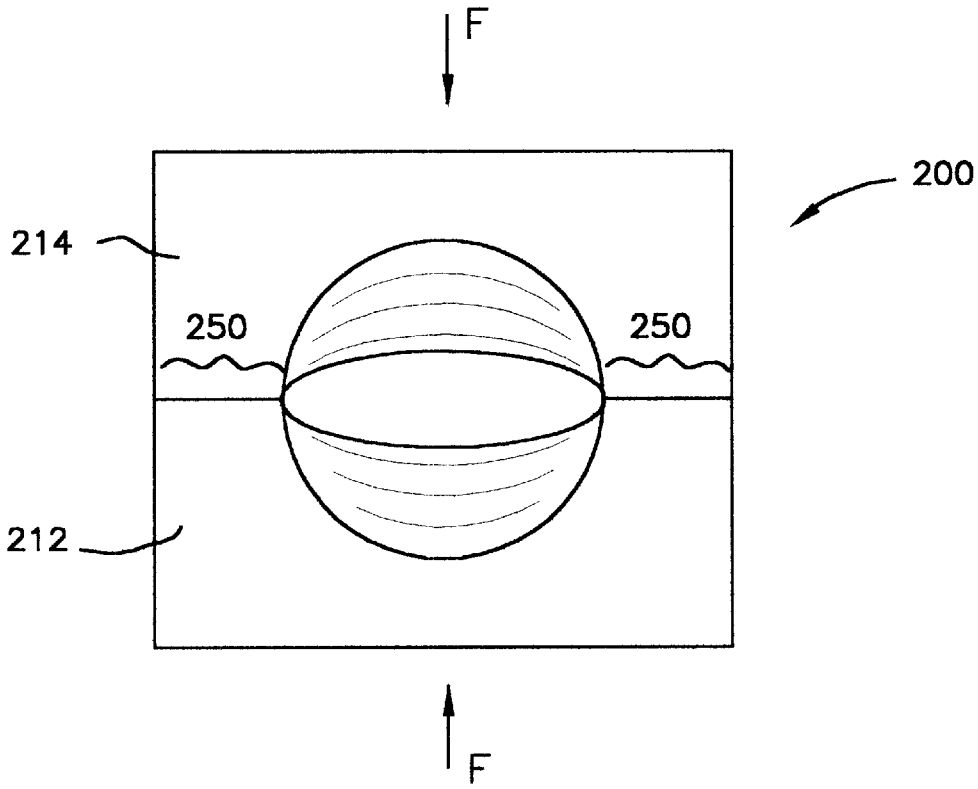
FIG. 6 is an end view of the die shown in FIG. 5 in which a predetermined compressive force is applied to the die.

First die section 212 comprises a pair of lands 260 each of which define a first surface portion 232. A second surface portion 234 is spaced or offset from each of first surface portions 232. When the dies are loaded by the clamping force in a press, the lands and adjacent portions of first die sections 212 and second die sections 214 are subject to elastic strain. As the load increases, the lands compress and eventually the entire surface forming parting lines 250 comes into contact as illustrated in FIG. 6.

Desirably, lands 260 are sized and configured so this occurs close to but below the elastic limit of the lands, e.g., within region R (FIG. 3). In particular, when first die section 212 and second die section 214 are clamped together for forming the part, second surface portion 234 engages second surface 240 and the stress on said first surface portion 232 is substantially equal to and less than an elastic limit of first die section 212 defining first surface portion 232 and the corresponding portion of surface 240. In particular, lands 260 are sized and configured to have a reduced height H2 compared to a height H1 (FIG. 2) of lands 60 (FIG. 2) described above with respect to first die section 12 (FIG. 2).

Since the entire parting line comes in contact, a greater compressive force can be applied to the dies without incurring permanent deformation of the lands and the adjacent portions of the die section. This design reduces the likelihood for failure (plastic deformation) in the land and die sections while allowing the lands to maintain an optimum pressure throughout the course of the production of parts even under extreme loading conditions. Such a design provides a safety mechanism in case the load on the die sections exceeds the normal operating condition. Lands 260 are desirably integrally formed with first die section 212. Alternatively, the lands may be formed by separately attachable rails or formed by various deposition techniques.

From the present description, it will be appreciated by those skilled in the art that while the illustrated lands have a generally planar shape, the lands may have other configurations such as a wedge shape, e.g., having an angled upper surface.

Figure 7:
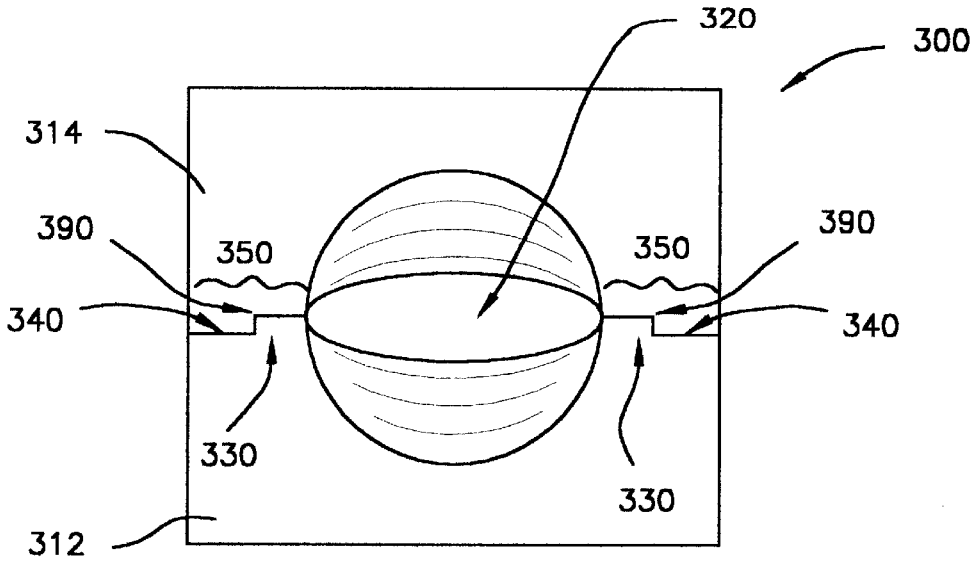
FIG. 7 is an end view of a die according to a third embodiment of the present invention for forming a part and controlling the formation of flash.

FIG. 7 illustrates a third embodiment of a die 300 of the present invention for forming a part (not shown) and for controlling the formation of flash. Advantageously, such a die is useful where the use of lands, as described above, cannot eliminate flash due to the combination of part geometry, die geometry, interface conditions, material properties, clamping forces, etc.

Figure 8:
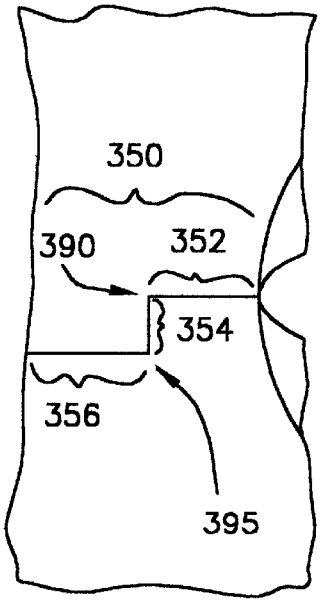
FIG. 8 is an enlarged view of a portion of one of the parting lines shown in FIG. 7.

Die 300 includes a first die section 312 and a second die section 314 which define a cavity 320 therein for forming a part. First die section 312 and second die section 314 have a pair of first surfaces 330 and a pair of second surfaces 340, respectively, which together define a pair of parting lines 350 each of which having a bend 390. As best shown in FIG. 8, parting line 350 includes a first parting line portion 352, a second parting line portion 354, and bend 390 disposed therebetween.

In this illustrative embodiment, first parting line portion 352 is planar-shaped and second parting line portion 354 is planar-shaped, and first parting line portion 352 is disposed at an angle from second parting line portion 354. As shown in FIG. 8, bend 390 is a right angle so that first parting line portion 352 is at a right angle from second parting line portion 354.

Advantageously, parting line 350 comprises bend 390 and a second bend 395. More particularly, parting line 350 includes first planar-shaped parting line portion 352, second planar-shaped parting line portion 354, and a third planar-shaped parting line portion 356. First and third parting line portions 352 and 356, respectively, are parallel to each other, and second planar-shaped parting line portion 354 is disposed at right angles to form bend 390 between first planar-shaped parting line portion 352 and second planar-shaped parting line portion 354. Bend 395 is disposed between second planar-shaped portion 354 and third planar-shaped parting line portion 356.

In addition, parting line 350 may be sized and configured so that the portions of first die section 312 and second die section 314 forming first planar-shaped parting line portion 352 are in contact when forming a part. Alternatively, parting line 350 may be size and configured so that first planar-shaped parting line portion 352 is provided with a gap or forms a passageway for forming a controlled amount of flash when forming a part.

The containment of flash when forming the part using die 300 is accomplished via the step configuration, as described above, in the parting line. Workpiece material is allowed to enter a passageway formed between surfaces along first parting line portion 352 of parting line 350. Flash may continue to move through the parting line until it comes into contact with bend 390 at which point the formations of flash is stopped or controlled by second parting line portion 354.

Figure 9:
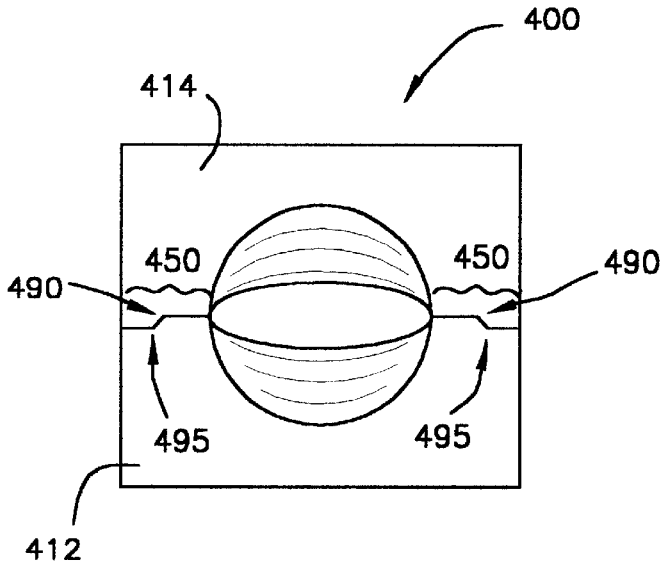
FIG. 9 is an end view of a die according to a fourth embodiment of the present invention for forming a part and for controlling the formation of flash.

FIG. 9 illustrates a fourth embodiment of die 400 which includes a first die section 412 and a second die section 414 and a pair of parting lines 450 disposed therebetween each of which parting lines having a pair of bends 490 and 495 which are at an angle of about 45 degrees. Such a configuration reduces the cracking propensity of the inside corner portion of bend 495 compared to the configuration of bend 395 shown in FIG. 8.

While the illustrated dies are shown with two halves or sections, from the present description, it will be appreciated by those skilled in the art that a die may have more than two sections, for example, to accommodate the shape of the part to be formed and the ability to disassembly the die and remove the part.

With reference again to FIGS. 1 and 2, to form a part using die 10, first and second die sections 12 and 14 are held together with a predetermined compressive force to apply a stress on the first surface portion 32 which is substantially equal to and less than the elastic limit of lands 60. A moldable material is provided, e.g., a slug, and the moldable material is introduced into cavity 20 to form the part.

With reference again to FIGS. 5 and 6, to form a part using die 200, first and second die sections 212 and 214 are held together with a compressive force to engage second surface portion 234 with second surface 240 so that a stress on first surface portion 232 is substantially equal to and less than an elastic limit of land 260. A moldable material is provided, e.g., a slug, and the moldable material is introduced into cavity 220 to form the part.

With reference again to FIG. 7, to form a part using die 300, first and second die sections 312 and 314 are held together, a moldable material is provided, and the moldable material is introduced into cavity 350 to form the part.

Thus, while various embodiments of the present invention have been illustrated and described, it will be appreciated to those skilled in the art that many changes and modifications may be made thereunto without departing from the spirit and scope of the invention.

What is claimed is:

1. A die for forming a part, said die comprising:

a first die section and a second die section defining a cavity therein for forming the part, said first die section and said second die section having a first surface and a second surface, respectively, which together define a parting line, said first die section having a solid land defining a first surface portion of said first surface, said first surface portion being configured to engage said second surface, and said first surface further comprising a second surface portion offset from said first surface portion, said second surface portion being offset from said second surface absent application of a clamping force to said die, wherein said land is sized and configured so that a stress on said first surface portion is substantially equal to and less than an elastic limit of said land when said first surface portion is engaged with said second surface and said first die section and said second die section are held together with a predetermined force during the forming of the part.

2. The die of claim 1 wherein said land is integrally formed with said first die section.

3. The die of claim 1 wherein said land comprises a separately attachable rail.

4. The die of claim 1 wherein said first die section and second die section define an inlet for receiving material for forming the part and an outlet for discharging the formed part.

5. The die of claim 1, wherein when said first die section and said second die section are held together with the predetermined force during the forming of the part, said second surface portion engages said second surface and the stress on said first surface portion is substantially equal to and less than an elastic limit of said land.

6. The die of claim 5 wherein said land is integrally formed with said first die section.

7. The die of claim 5 wherein said land comprises an attachable rail.

8. The die of claim 5 wherein said first die section and second die section define an inlet for receiving material for forming the part and an outlet for discharging the formed part.

9. A die for forming a part, said die comprising:

a first die section and a second die section defining a cavity therein for forming the part; and said first die section and said second die section having a first surface and a second surface, respectively, which together define a parting line having at least one bend comprising an angle of about 45°.

10. The die of claim 9 wherein said parting line comprises a first parting line portion, a second parting line portion, and said at least one bend is disposed therebetween.

11. The die of claim 9, wherein said parting line comprises a first parting line portion, a second parting line portion, and a third parting line portion, and wherein said first and said third parting line portions are parallel to each other and said second parting line portion is at an angle of about 45° to form said bend between said first parting line portion and said second parting line portion, and a second bend comprising an angle of about 45° between said second parting line portion and said third parting line portion.

12. A method for forming a die for forming a part, said method comprising:

providing a first die section and a second die section defining a cavity therein for forming the part, the first die section and the second die section having a first surface and a second surface, respectively, which together define a parting line, the first surface comprising a second surface portion which is offset from the second surface absent application of a clamping force to the die sections; and forming a solid land defining a first surface portion of the first surface offset from the second surface portion, the first surface portion being configured to engage the second surface, and the solid land being sized and configured so that a stress on the first surface portion is substantially equal to and less than an elastic limit of the land when the first surface portion is engaged with the second surface and the first die section and the second die section are held together with a predetermined force during the forming of the part.

13. The method of claim 12, wherein forming the land further comprises sizing and configuring the land so that when the first die section and the second die section are held together with the predetermined force during the forming of the part, the second surface portion engages the second surface.

14. A method for forming a die for forming a part, said method comprising:

providing a first die section and a second die section defining a cavity therein for forming the part; and forming on the first die section and the second die section a first surface and a second surface, respectively, which together define a parting line having at least one bend comprising an angle of about 45°.

15. The method of claim 14, wherein the at least one bend comprises a first bend and a second bend, the first and second bends comprising angles of about 45°.

16. A method for forming a part, said method comprising:

providing a die comprising a first die section and a second die section defining a cavity therein, the first die section and the second die section having a first surface and a second surface, respectively, which together define a parting line, the first die section having a solid land defining a first portion of the first surface, the first surface further comprising a second surface portion offset from the first surface portion, the second surface portion being offset from the second surface absent application of a clamping force to the die;

engaging the first surface portion with the second surface;

holding the first die section and the second die section together with a predetermined force to apply a stress on the first surface portion substantially equal to and less than an elastic limit of the land; and introducing a moldable material into the cavity to form the part.

17. The method of claim 16, wherein holding the first die section and the second die section together further comprises engaging the second surface with the second surface portion.

18. A method for forming a part, said method comprising:

providing a die comprising a first die section and a second die section defining a cavity therein, the first die section and the second die section having a first surface and a second surface, respectively, which together define a parting line having at least one bend comprising an angle of about 45°;

holding the first and second die sections together; and introducing a moldable material into the cavity to form the part.

* * * * *